United States Patent [19]

Budrow et al.

[11] Patent Number: 4,663,632

[45] Date of Patent: May 5, 1987

[54] EXTENDABLE DIRECTIONAL DIPOLE ANTENNA

[75] Inventors: Jack C. Budrow; Glenn A. Reed, both of Battle Creek, Mich.

[73] Assignee: Barker Manufacturing Company, Inc., Battle Creek, Mich.

[21] Appl. No.: 695,562

[22] Filed: Jan. 28, 1985

[51] Int. Cl.[4] ..... H01Q 1/10; H01Q 9/16

[52] U.S. Cl. ..... 343/714; 343/823; 343/903; 343/882

[58] Field of Search ..... 343/713, 714, 823, 757, 343/889, 901, 903, 882, 715, 900, 888

[56] References Cited

U.S. PATENT DOCUMENTS

| | | | |
|---|---|---|---|
| 2,204,861 | 6/1940 | Knapp | 343/714 |
| 2,327,163 | 8/1943 | Barrett | 343/903 |
| 2,341,401 | 2/1944 | White | 343/903 |
| 2,344,490 | 3/1944 | Brach | 343/903 |
| 2,476,469 | 7/1949 | Walker | 343/823 |
| 2,537,481 | 1/1951 | Parsons | 343/823 |
| 2,569,810 | 10/1951 | Hamel et al. | 343/823 |
| 2,778,017 | 1/1957 | Dorcsjak | 343/823 |
| 3,065,942 | 11/1962 | Cameron | 343/714 |
| 3,665,477 | 5/1972 | Budrow et al. | 343/714 |
| 4,426,650 | 1/1984 | Korsen | 343/903 |

*Primary Examiner*—Eli Lieberman
*Assistant Examiner*—Michael C. Wimer
*Attorney, Agent, or Firm*—Beaman & Beaman

[57] ABSTRACT

The invention pertains to an extendable directionally adjusted dipole antenna particularly suitable for use with recreational vehicles. The antenna includes a vertical column having an extendable dipole arrangement at its upper end utilizing flexible actuators associated with a pair of reels whereby the actuators and associated telescoping antenna assemblies are simultaneously extended and retracted. An operating shaft for rotating the reels extends through the column and either manual or electric means rotate the shaft. The column is rotatable for directional adjustment, and under manual control the shaft extends through the vehicle roof permitting interior adjustments.

7 Claims, 9 Drawing Figures

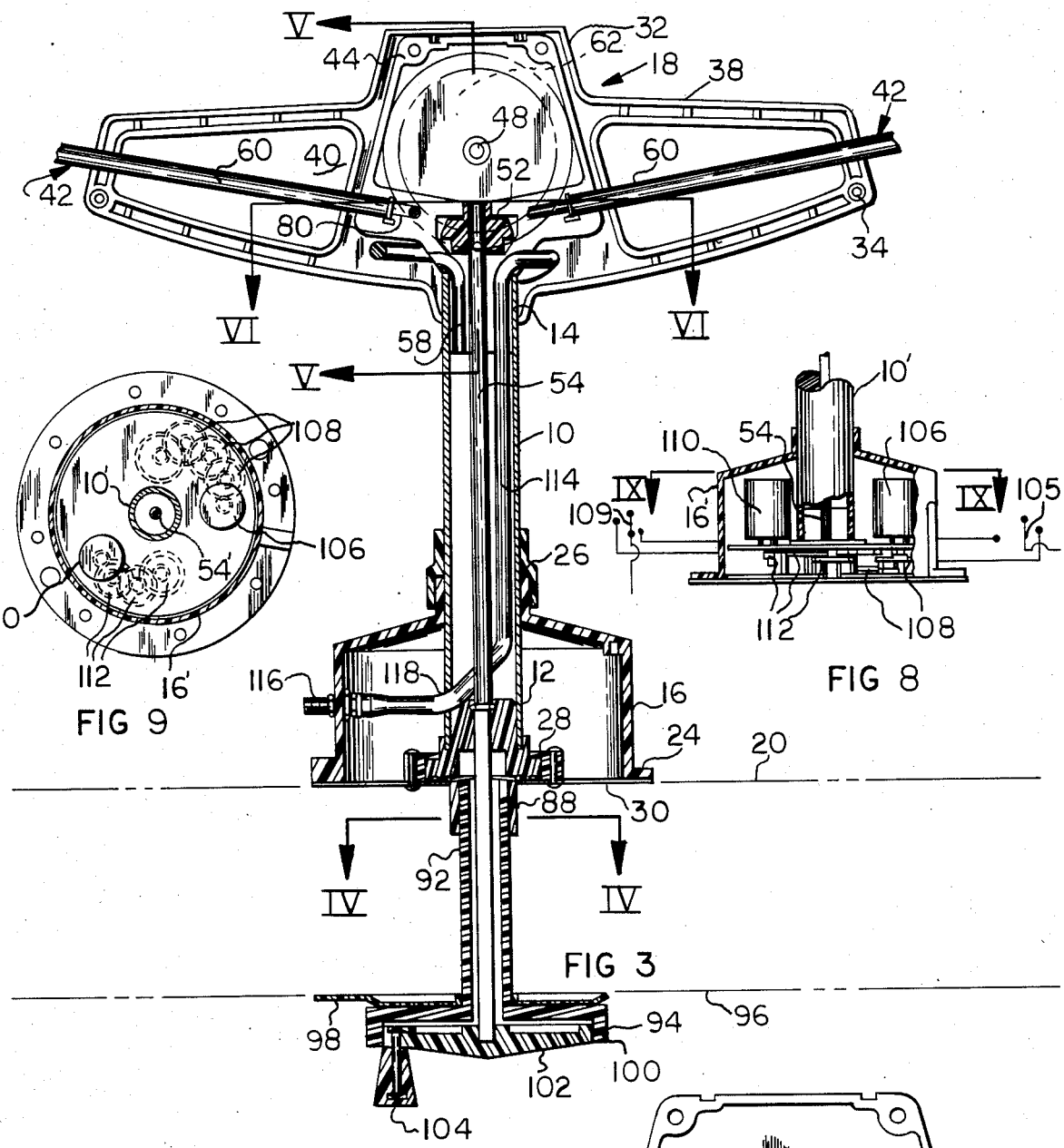
FIG 9
FIG 8
FIG 3
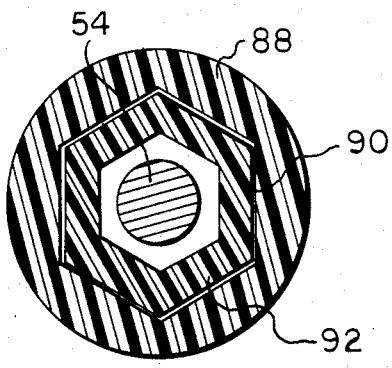
FIG 4
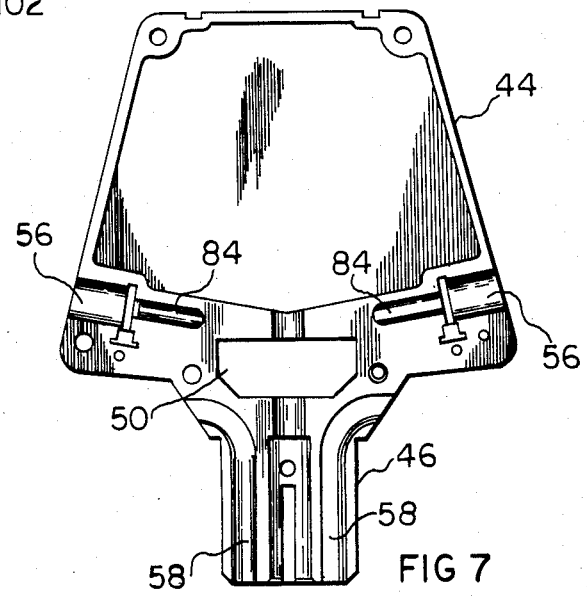
FIG 7

EXTENDABLE DIRECTIONAL DIPOLE ANTENNA

BACKGROUND OF THE INVENTION

Recreational vehicles such as motor homes, trailers, and the like often include among their amenities television sets, FM stereo receivers, and other electronic equipment receiving atmospheric transmitted signals. Various types of antennas have been developed for recreational vehicle use having characteristics particularly suitable for this type of installation, a typical example being shown in the assignee's U.S. Pat. No. 3,665,477.

Dipole antennas are particularly advantageous as used with television receivers, but a relatively inexpensive efficient dipole antenna for recreational vehicle use utilizing extendable and retractable telescoping antenna assemblies has not previously been available, and the invention pertains to a dipole antenna particularly suitable for recreational vehicle installations. While extendable and retractable dipole antennas have been known as shown in U.S. Pats. Nos. 2,569,810 and 2,778,017, and while it is known to extend and retract telescoping antenna elements with flexible actuators as shown in U.S. Pats. Nos. 2,327,163; 2,344,490 and 4,426,650, antenna structure has not previously been available which is capable of withstanding the rugged and versatile service required in a recreational vehicle installation, nor has an adjustable and directional dipole antenna been available for recreational vehicles wherein operation of the antenna is possible by remote control, or by manual actuation within the vehicle interior.

It is an object of the invention to provide an adjustable dipole antenna for recreational vehicle use wherein the extension and retraction of dipole antenna assemblies, and rotation of these assemblies may be remotely achieved within the interior of the vehicle.

Another object of the invention is to provide a fully adjustable dipole antenna wherein extendable and retractable telescoping antenna assemblies are simultaneously operated by flexible actuators through a common driveshaft.

An additional object of the invention is to provide an adjustable dipole antenna particularly suitable for recreational vehicle installations which is capable of withstanding the vibration and rugged usage of such installations, is readily installable requiring a minimum of technical skills, dependable in operation, and easily assembled.

Yet a further object of the invention is to provide a dipole antenna having telescoping antenna assemblies operated by flexible actuators mounted upon reels wherein the reel construction assures uniform operating characteristics under adverse conditions and wherein the actuator is smoothly discharged from the reel and rewound thereon without binding and kinking.

A further object of the invention is to provide a dipole antenna particularly suitable for recreational vehicle installations wherein, with minor modifications, the operating and adjustment functions of the antenna may be remotely controlled from the vehicle interior by either manual or electrically operated apparatus.

In the practice of the invention the antenna includes a vertically disposed column adapted to be rotatably mounted upon the vehicle roof or similar vehicle structure for rotation about a substantially vertical axis. At its upper end, the column is provided with a support for a pair of telescoping dipole antenna assemblies each consisting of several tubular telescoping elements which extend in substantially opposite directions from the column. Interiorly, the antenna assemblies include a flexible actuator, such as a synthetic plastic rod attached to the outermost antenna element at one end, and the other end being affixed to a reel rotatably mounted adjacent the column upper end. Each actuator is mounted upon a separate reel, and the reels include gear teeth engaging a pinion mounted upon a shaft extending through the column whereby rotation of the shaft simultaneously rotates the reels producing simultaneous retraction and extension of the antenna assemblies.

The lower end of the column is mounted within a housing affixed to the vehicle roof, and the reel operating shaft extends into this housing. In the manually operated embodiment a concentric control knob and crank coaxially aligned with the column extend through the vehicle roof for access within the vehicle interior. The knob is attached to the column for producing selective rotation of the column about its vertical axis, and the crank is attached to the reel driveshaft for producing rotation of the reels to extend and retract the antenna assemblies.

If the remote control of the antenna operations are electrically produced, electric motors located within the housing and controlled by switches within the vehicle interior rotate the column and reel driveshaft to extend and retract the antenna assemblies and rotate the column for directional adjustment.

Smooth dispensing of the flexible antenna actuators from their associated reel, and rewinding thereon, is assured by dispensing the actuator rod from the reel at the inner reel end, and utilizing a conical actuator receiving surface in spaced radial relationship to a complementary actuator retaining surface thereby preventing overlapping of the actuator rod during antenna retraction and preventing actuator malfunctions.

BRIEF DESCRIPTION OF THE DRAWINGS

The aforementioned objects and advantages of the invention will be appreciated from the following decription and accompanying drawings wherein:

FIG. 3 is an elevational view of the antenna assembly in diametrical section, FIG. 4 is a plan, sectional view taken through Section IV—IV of FIG. 3, FIG. 7 is a side, elevational view of a half of the reel support plate, FIG. 8 is a detail, elevational, partially sectional view of the column housing of an electrically operated embodiment, and FIG. 9 is a plan, sectional view of the embodiment of FIG. 8 taken along Section IX—IX of FIG. 8.

DESCRIPTION OF THE PREFERRED EMBODIMENTS

Figure 1:
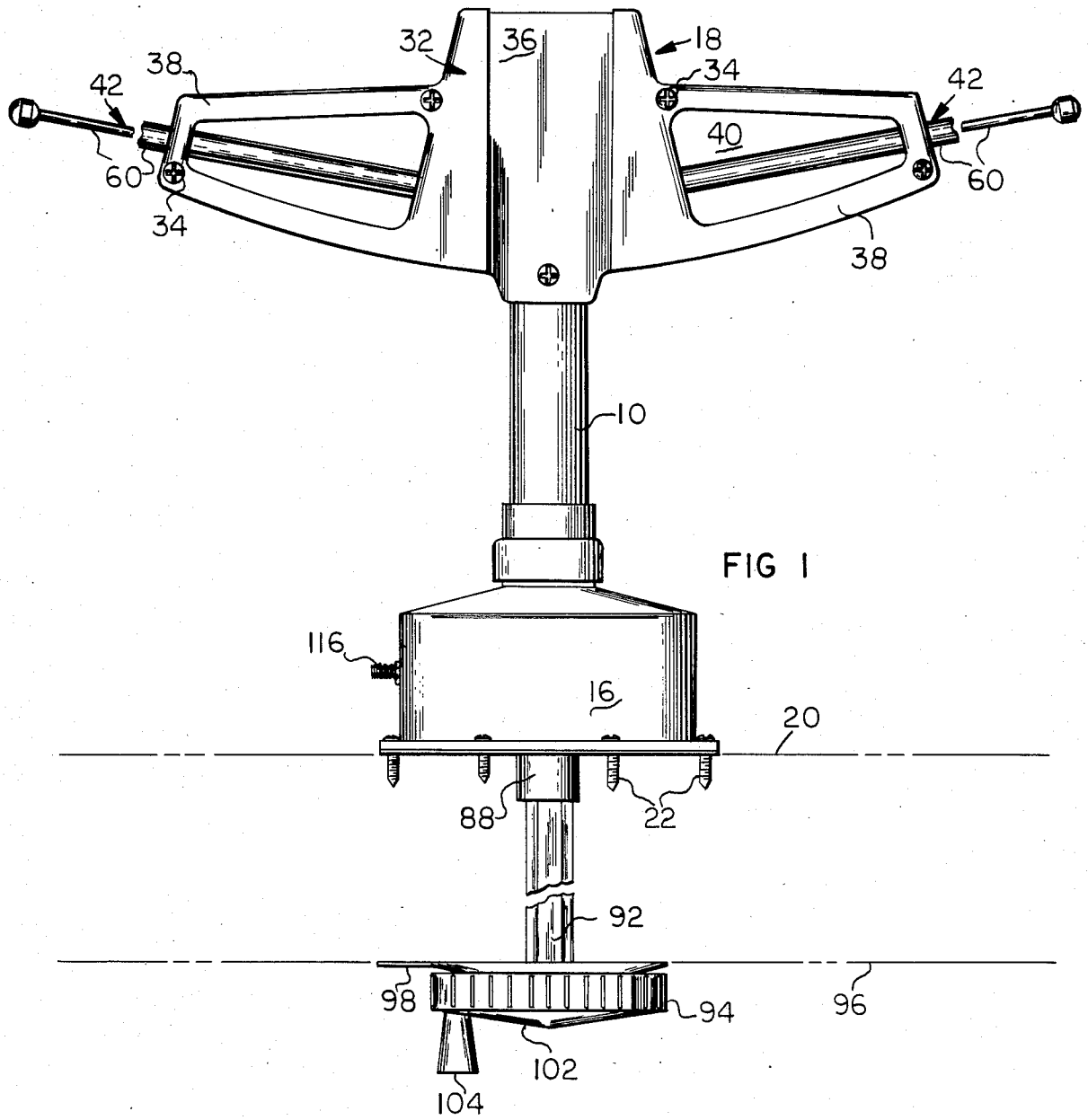
FIG. 1 is an elevational view illustrating an adjustable dipole antenna of the manual type in accord with the invention.
Figure 2:
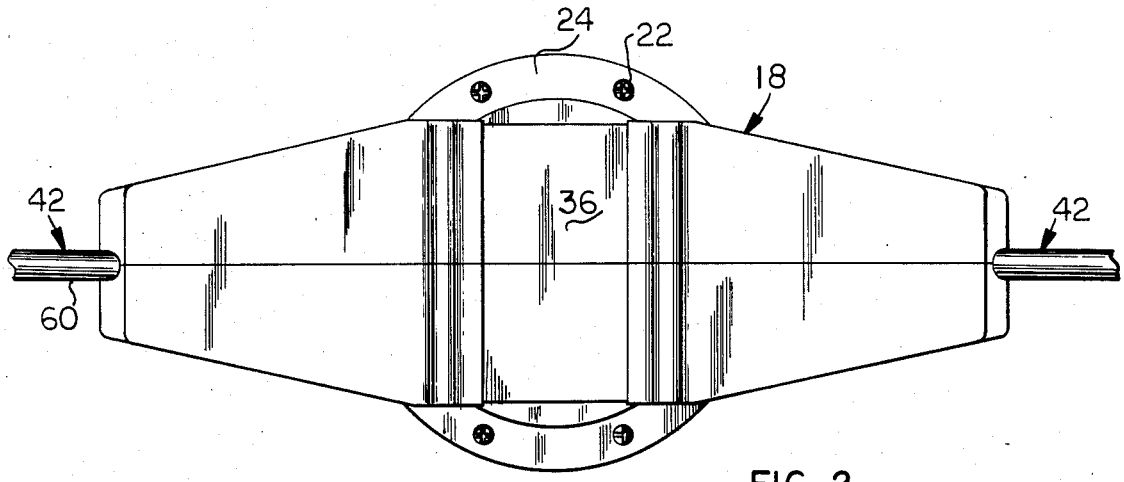
FIG. 2 is a top plan view of FIG. 1.

The general relationships of a dipole antenna in accord with the invention will be best appreciated from FIGS. 1–3. The antenna includes an elongated, cylindrical column 10 having an axis substantially vertically oriented, a lower end 12, and an upper end 14. A synthetic plastic housing 16, FIG. 3, encompasses the lower end of the column and supports the column in its vertical orientation, and the dipole supporting structure generally indicated at 18, is mounted upon the column upper end.

The housing 16 is mounted upon the roof of a recreational vehicle, as generally indicated in phantom lines at 20, and this connection is accomplished by screws 22, FIG. 1, extending through the housing flange 24. Bearing structure 26 defined upon the housing rotatably engages the column, and the lower bearing structure 28 mounted upon the housing bottom plate 30 further provides rotative support of the column 10. Thus, it will be appreciated that the column 10 is supported in the housing 16 for rotation about its longitudinal vertical axis.

The support structure 18 for the dipoles located at the upper end of the column include a pair of synthetic plastic molded components 32 of similar form which are interconnected by screws 34, FIG. 1. These components includes a central housing region 36, and open wing sections 38 having holes 40 defined therein for receiving the antenna dipole assemblies 42, as later described.

Figure 5:
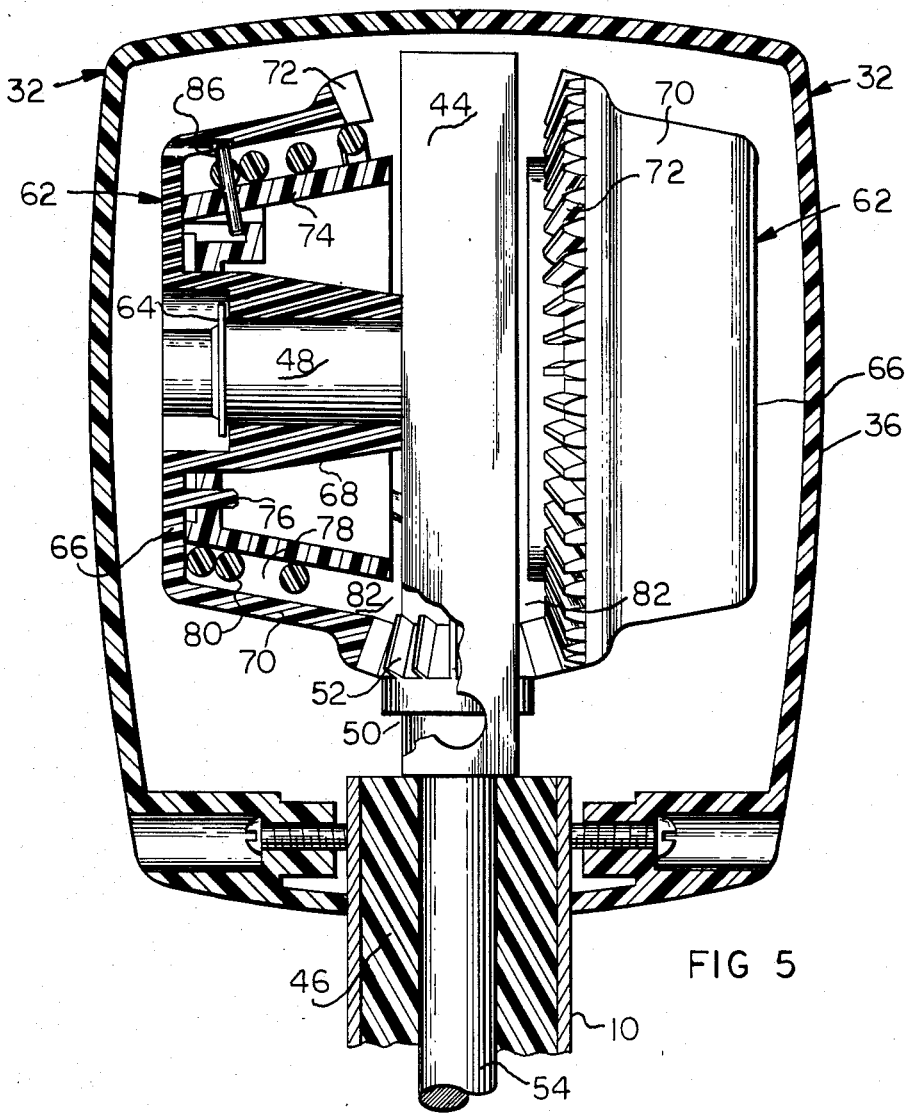
FIG. 5 is an enlarged, elevational view, partially in section, taken through the reel housing along Section V—V of FIG. 3.

The central housing 36 encompasses a two-part synthetic plate member 44 which is mounted in the upper end 14 of the column by cylindrical stem 46 and the upper flat region of the plate includes stub axles 48, FIG. 5, extending from either side of the plate. The plate 44 is recessed at 50 to provide clearance for a bevel pinion gear 52 mounted upon shaft 54 located within the column 10 and rotatably supported at its upper end within the plate. In this manner the pinion gear 52 extends on opposite sides of the flat plate plate 44, as will be apparent from FIG. 6. As will be noted in FIG. 7, wherein only one of the parts that form plate 44 is illustrated, the plate includes cylindrical recesses 56 for receiving the inner ends of the dipole assemblies 42, and passages 58 for the antenna lead cable.

A pair of dipole antenna assemblies 42 are mounted within the support structure 18, as best appreciated from FIG. 3. The assemblies 42 are identical, and each consists of a plurality of telescoping antenna elements 60, as is well known in the antenna art. The larger inner elements 60 are received within holes 40 defined within the wings 38, and the inner ends of the antenna assemblies are open and received within the plate recesses 56 for receiving the antenna actuator rods, as later described. As will be appreciated from FIG. 1, the antenna's assemblies 42 project in substantially opposite directions from the axis of the column 10.

A synthetic plastic reel 62 is rotatably mounted upon each stub axle 48 of plate 44, and retained thereon by ring 64, FIG. 5. Each reel includes a dish-shaped retainer 66 having a hub 68 extending across the stub axle, and the angularly related retainer portion 70 terminates in an annular free edge upon which gear teeth 72 are defined. Internally, the reel structure includes the actuator rod support 74 of annular configuration and obliquely oriented to the axis of axle 48 as to correspond to the angular orientation of the retainer portion 70. The members 66 and 74 are keyed together by pins 76, to insure simultaneous rotation thereof, and an annular obliquely disposed chamber 78 is defined between support 74 and retainer portion 70 within which the flexible synthetic plastic actuator rod 80 is received and wound.

The chamber 78 is open at the inner portion of the associated reel as at 82, permitting the actuator rods 80 to enter and leave the reel chamber 78 during reel rotation. The lower portion of the chamber opening 82 is substantially tangential to the alignment of the adjacent ends of the assemblies 42, and the actuator rods 80 extend from the reels into the plate guide passages 84, FIG. 7, and through the inner ends of the antenna elements 60 into the antenna assemblies.

The actuator rods 80 are affixed to the outermost antenna element 60 and at their inner ends the actuator rods are attached to the reel structure by a pin 86, FIG. 5.

Figure 6:
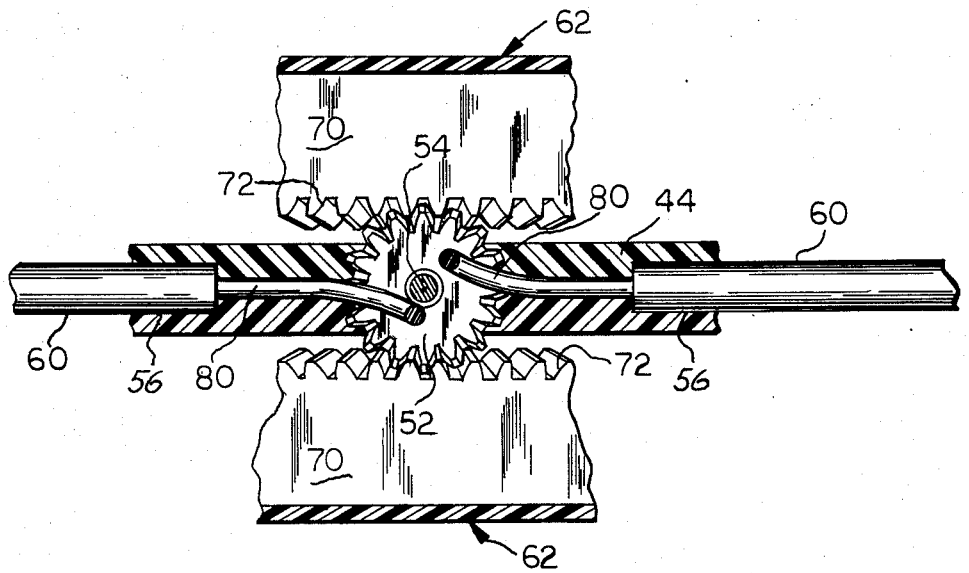
FIG. 6 is an enlarged, detail, sectional view of the reel and reel drive pinion as taken along Section VI—VI of FIG. 3.

As will be appreciated from FIG. 6, the teeth of the pinion gear 52 simultaneously mesh with the teeth 72 of the two reels 62 and rotation of the pinion gear simultaneously rotates the reels in opposite directions. This reel rotation will feed the actuator rods 80 into the antenna assemblies 60, or withdraw the rod from the assemblies, depending on the direction of reel rotation, and it will be appreciated that rotation of the shaft thereby simultaneously extends or retracts the dipole assemblies. Guiding passages 84, FIG. 7, formed in the plate 44 aid in guiding the movement of the actuator rods 80, and the angular oblique orientation of the reel members and the close confinement of the actuator rods 80 within the chambers 78 insures close control and positioning of the actuator rods on the reels preventing kinking and twisting, and the extension and retraction of the dipole assemblies 42 is smoothly accomplished.

In FIGS. 1 and 2, the manually operated remote mechanism for controlling the antenna's functions is illustrated in full lines. This apparatus includes an extension 88 of the bearing 28, which extends into the vehicle roof 20, and this extension is provided with an internal hexagonal bore 90, FIG. 4, for receiving the hexagonal stem 92 of the knob 94 to provide a keyed relationship between the stem and bearing extension. At its lower end, the knob 94 will be located adjacent the ceiling 96 of the recreational vehicle, and a plate 98 may be affixed to the ceiling to indicate the relative position of the antenna structure. The knob is preferably provided with a friction producing circumference as by molding a plurality of vertically extending ribs thereon, and the knob includes a recess 100 concentric with the knob configuration.

The shaft 54 is rotatably mounted within the housing bearing 28 and extends through the stem 92 and is keyed to the crank 102 rotatably located within the knob recess 100, FIG. 3. The crank includes a handle 104, and it will be appreciated that rotation of the handle 104, crank 102, shaft 54 and pinion gear 52 may be readily achieved from within the vehicle.

From the above it will be appreciated that both the extension and retraction of the dipole assemblies 42 and the rotation of the column and antenna structure may be readily and easily achieved from within the vehicle, and the direction of orientation of the dipole assembly is readily appreciated by the relative relationship of the knob 94 and the plate 98.

It is also within the purview of the invention to use electric motors to rotate the column 10 and extend and retract the antenna dipole assemblies 42, and in such instance, electric motor structure is mounted within the housing 16. In FIGS. 8 and 9 a motorized embodiment is shown and primed reference numerals are used to denote previously described components. A motor 106 includes transmission step-down gearing 108 connected to the column 10' for rotating the column, and the motor 110 and associated transmission 112 is operatively connected to the shaft 54. The motors 106 and 110 are reversible and controlled by conventional electrical switches schematically shown at 105 and 109, respectively, and the motors are powered through the regular electric circuit of the recreational vehicle. With the electrical remote control embodiment it is not necessary to form a hole in the vehicle roof for the column or shaft, and this embodiment permits a wider choice of antenna mounting locations than does the manual remote control apparatus described above.

Terminals are mounted on the plate 44, not shown, for connecting of the antenna lead wire 114 to the dipole assemblies 42, and the antenna lead 114 passes through a plate passage 58 and the column 10 to the connection 116 on the housing for attachment to a conventional coaxial cable. As will be appreciated from FIG. 3, the column 10 is provided with a hole to accommodate the lead and sufficient lead length is provided to permit rotation of the column.

From the above description it will be appreciated that the adjustable dipole antenna structure of the invention achieves the desired results. A smooth operating antenna is produced capable of efficient operation over extended periods of time without maintenance, and as the vertical extension of the column above the vehicle roof is relatively low the likelihood of damage to the antenna structure is reduced, and the retraction of the dipole assemblies minimizes the likelihood of damage to the dipole assemblies during travel and nonuse. The widespread use of synthetic plastic moldings reduces costs and simplifies assembly, and also reduces the likelihood of corrosion.

It is appreciated that various modifications to the inventive concepts may be apparent to those skilled in the art without departing from the spirit and scope of the invention.

We claim:

1. An extendable dipole antenna particularly suitable for mounting upon the roof of a vehicle comprising, in combination, a vertically oriented column having an axis lying within a vertical plane, an upper end and a lower end, roof mounting means defined on said column lower end, a dipole support mounted upon said column upper end symmetrically related to said column vertical plane, dipole antenna apparatus mounted upon said support comprising a pair of elongated antenna assemblies each consisting of a plurality of selectively adjustable telescoping elements lying within said column vertical plane positionable between extended and retracted positions, a pair of reels rotatably mounted upon said support on opposite sides of said vertical plane, a flexible elongated antenna assembly actuator comprising a synthetic plastic rod wound upon each reel having an inner end affixed to the associated reel outside of said vertical plane and an outer end operatively connected to the elements of an antenna assembly within said vertical plane, reel drive means within said column having an upper end operatively connected to said reels for simultaneously selectively rotating said reels in opposite directions and a lower end extending at least to said column lower end, and a reel drive means operator operatively connected to said reel drive means lower end whereby operation of said drive means operator rotates said reels to selectively extend and retract said antenna assemblies.

2. An extendable dipole antenna particularly suitable for mounting upon the roof of a vehicle comprising, in combination, a vertically oriented column having an axis, and upper end and a lower end, roof mounting means defined on said column lower end, bearing means defined upon said roof mounting means rotatably supporting said column for rotation about its axis, column rotating means attached to said column lower end, a dipole support mounted upon said column upper end, dipole antenna apparatus mounted upon said support comprising a pair of antenna assemblies each consisting of a plurality of selectively adjustable telescoping elements positionable between extended and retracted positions, a pair of reels rotatably mounted upon said support, a flexible elongated antenna assembly actuator wound upon each reel having an inner end affixed to the associated reel and an outer end operatively connected to the elements of an antenna assembly, reel drive means within said column having an upper end operatively connected to said reels for simultaneously selectively rotating said reels in opposite directions and a lower end extending at least to said column lower end, and a reel drive means operator operatively connected to said reel drive means lower end whereby operation of said drive means operator rotates said reels to selectively extend and retract said antenna assemblies, said reel drive means including a shaft rotatably supported within said column having an upper end and a lower end, a gear fixed to said shaft upper end, gear teeth defined on said reels in mesh with said gear, said reel drive means operator operatively connected to said shaft lower end, said dipole support including a plate having opposite sides and aligned with and intersected by said column axis, an axle mounted in each side of said plate having an axis transverse to said column axis, a reel rotatably mounted upon each axle, said shaft upper end being rotatably supported in said plate.

3. In an extendable dipole antenna as in claim 2, said roof mounting means comprising a housing, said column lever end extending into said housing, a first electric drive within said housing operatively connected to said column lower end, a second electric drive within said housing operatively connected to said shaft lower end and switch means connected to said electric drives for the control thereof.

4. An extendable dipole antenna particularly suitable for mounting upon the roof of a vehicle comprising, in combination, a vertically oriented column having an axis, an upper end and a lower end, roof mounting means defined on said column lower end, bearing means defined upon said roof mounting means rotatably supporting said column for rotation about its axis, column rotating means attached to said column lower end, a dipole support mounted upon said column upper end, dipole antenna apparatus mounted upon said support comprising a pair of antenna assemblies each consisting of a plurality of selectively adjustable telescoping elements positionable between extended and retracted positions, a pair of reels rotatably mounted upon said support, a flexible elongated antenna assembly actuator wound upon each reel having an inner end affixed to the associated reel and an outer end operatively connected to the elements of an antenna assembly, reel drive means within said column having an upper end operatively connected to said reels for simultaneously selectively rotating said reels in opposite directions and a lower end extending at least to said column lower end, and a reel drive means operator operatively connected to said reel drive means lower end whereby operation of said drive means operator rotates said reels to selectively extend and retract said antenna assemblies, said reel drive means including a shaft rotatably supported within said column having an upper end and a lower end, a gear fixed to said shaft upper end, gear teeth defined on said reels in mesh with said gear, said reel drive means operator operatively connected to said shaft lower end, said column and shaft lower ends extending below said roof mounting means for access within the vehicle interior, a directional knob mounted on said column lower end and said reel drive means operator comprising a crank mounted upon said shaft lower end.

5. In an extendable dipole antenna as in claim 4, said knob having a circular periphery and a central recess, said crank being mounted within said recess.

6. An extendable dipole antenna particularly suitable for mounting upon the roof of a vehicle comprising, in combination, a vertically oriented column having an axis, an upper end and a lower end, roof mounting means defined on said column lower end, a dipole support mounted upon said column upper end, dipole antenna apparatus mounted upon said support comprising a pair of antenna assemblies each consisting of a plurality of selectively adjustable telescoping elements positionable between extended and retracted positions, a pair of reels rotatably mounted upon said support, a flexible elongated antenna assembly actuator wound upon each reel having an inner end affixed to the associated reel and an outer end operatively connected to the elements of an antenna assembly, reel drive means within said column having an upper end operatively connected to said reels for simultaneously selectively rotating said reels in opposite directions and a lower end extending at least to said column lower end, and a reel drive means operator operatively connected to said reel drive means lower end whereby operation of said drive means operator rotates said reels to selectively extend and retract said antenna assemblies, said reels each including an axis of rotation, an outer side, an inner side, an actuator receiving surface concentric to said reel axis and torque transmitting means operatively connected to said reel drive means upper end, said actuator receiving surface being conical and converging toward said outer side, said actuator being dispensed from said conical surface adjacent said inner side, and an actuator confinement surface defined on said reel substantially parallel to and radially spaced outwardly from said conical actuator receiving surface a distance slightly greater than the diameter of said flexible actuator confining said actuator on said conical surface during extension of said antenna assemblies, said conical and confinement surfaces terminating adjacent said reel inner side defining an annular slot through which said flexible actuator passes during antenna assembly retraction and extension.

7. In an extendable dipole antenna as in claim 6, said reels including a cup-shaped portion defining said reel outer side and said actuator confinement surface having a free edge adjacent said reel inner side, gear teeth defined in said free edge, said reel drive means including a gear in mesh with said gear teeth.

* * * * *